US006827659B1

(12) United States Patent
Chen

(10) Patent No.: US 6,827,659 B1
(45) Date of Patent: Dec. 7, 2004

(54) BAT STRUCTURE MADE OF PLANT

(76) Inventor: Shih-Pao Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/676,421

(22) Filed: Sep. 29, 2003

(51) Int. Cl.[7] ..... A63B 59/06
(52) U.S. Cl. ..... 473/564
(58) Field of Search ..... 473/564–568, 473/457, 519, 520

(56) References Cited

U.S. PATENT DOCUMENTS

| | | | | | |
|---|---|---|---|---|---|
| 310,248 | A | * | 1/1885 | Brown | 473/564 |
| 533,272 | A | * | 1/1895 | Burrows | 473/520 |
| 795,815 | A | * | 8/1905 | Burrows | 473/564 |
| 813,400 | A | * | 2/1906 | Buehler | 473/564 |
| 1,450,646 | A | * | 4/1923 | Sadenwater | 473/564 |
| 1,549,803 | A | * | 8/1925 | Rastetter | 473/564 |
| 1,601,915 | A | * | 10/1926 | Hillerich | 473/564 |
| 2,379,006 | A | * | 6/1945 | Johnson | 473/568 |
| 2,458,919 | A | * | 1/1949 | Marsden | 473/564 |
| 6,007,440 | A | * | 12/1999 | Bender et al. | 473/564 |
| 6,010,417 | A | * | 1/2000 | Young et al. | 473/564 |
| 6,334,823 | B1 | * | 1/2002 | Holman | 473/564 |
| 2004/0029660 | A1 | * | 2/2004 | Chen et al. | 473/564 |

* cited by examiner

*Primary Examiner*—Mark S. Graham

(57) ABSTRACT

A bat structure includes a central portion, two symmetrical opposite side enclosure portions, and two symmetrical opposite outer enclosure portions. The central portion has a square cross-section, and the two side enclosure portions and the two outer enclosure portions are wound around the four sides of the central portion in a staggered manner. Thus, the bat structure can provide a shock-absorbing effect to prevent the bat structure from being broken due to a larger shock, thereby increasing the lifetime of the bat structure. In addition, the batter can feel more comfortable when the bat structure hits the ball.

11 Claims, 3 Drawing Sheets

BAT STRUCTURE MADE OF PLANT

BACKGROUND OF THE INVENTION

1. Field of the Invention

The present invention relates to a bat structure made of the plant, and more particularly to a bat structure that can provide a shock-absorbing and buffering effect.

2. Description of the Related Art

A conventional bat is made of harder wood which is formed by a turning process. However, when the bat hits the ball which is rotated at a high speed, the bat is directly subjected to the striking force from the ball, so that the batter easily feels uncomfortable due to the shock or vibration. In addition, the bat is easily broken due to a larger shock by the ball, thereby decreasing the lifetime of the bat.

SUMMARY OF THE INVENTION

The primary objective of the present invention is to provide a bat structure, wherein the striking force from either one of the two side enclosure portions or either one of the two outer enclosure portions is absorbed by the plates of the central portion to provide a shock-absorbing and buffering effect, so that the batter can feel more comfortable when the bat-structure hits the ball.

Another objective of the present invention is to provide a bat structure that can provide a shock-absorbing and buffing effect to prevent the bat structure from being broken due to a larger shock, thereby increasing the lifetime of the bat structure.

In accordance with the present invention, there is provided a bat structure, comprising a central portion, two symmetrical opposite side enclosure portions, and two symmetrical opposite outer enclosure portions, wherein:

- the central portion has a substantially square cross-section and has four sides;
- the central portion includes a plurality of plates;
- the two opposite side enclosure portions and the two opposite outer enclosure portions are wound around the four sides of the central portion in a staggered manner;
- each of the two side enclosure portions includes a plurality of plates;
- the bonding faces between the plates of each of the two side enclosure portions are vertical to the bonding faces between the plates of the central portion;
- each of the two side enclosure portions has a hardness greater than that of the central portion;
- each of the two outer enclosure portions includes a plurality of plates;
- the plates of each of the two outer enclosure portions are laminated, pressed and bonded together to form each of the two outer enclosure portions;
- each of the two outer enclosure portions has a hardness greater than that of the central portion.

Further benefits and advantages of the present invention will become apparent after a careful reading of the detailed description with appropriate reference to the accompanying drawings.

DETAILED DESCRIPTION OF THE INVENTION

Figure 1:
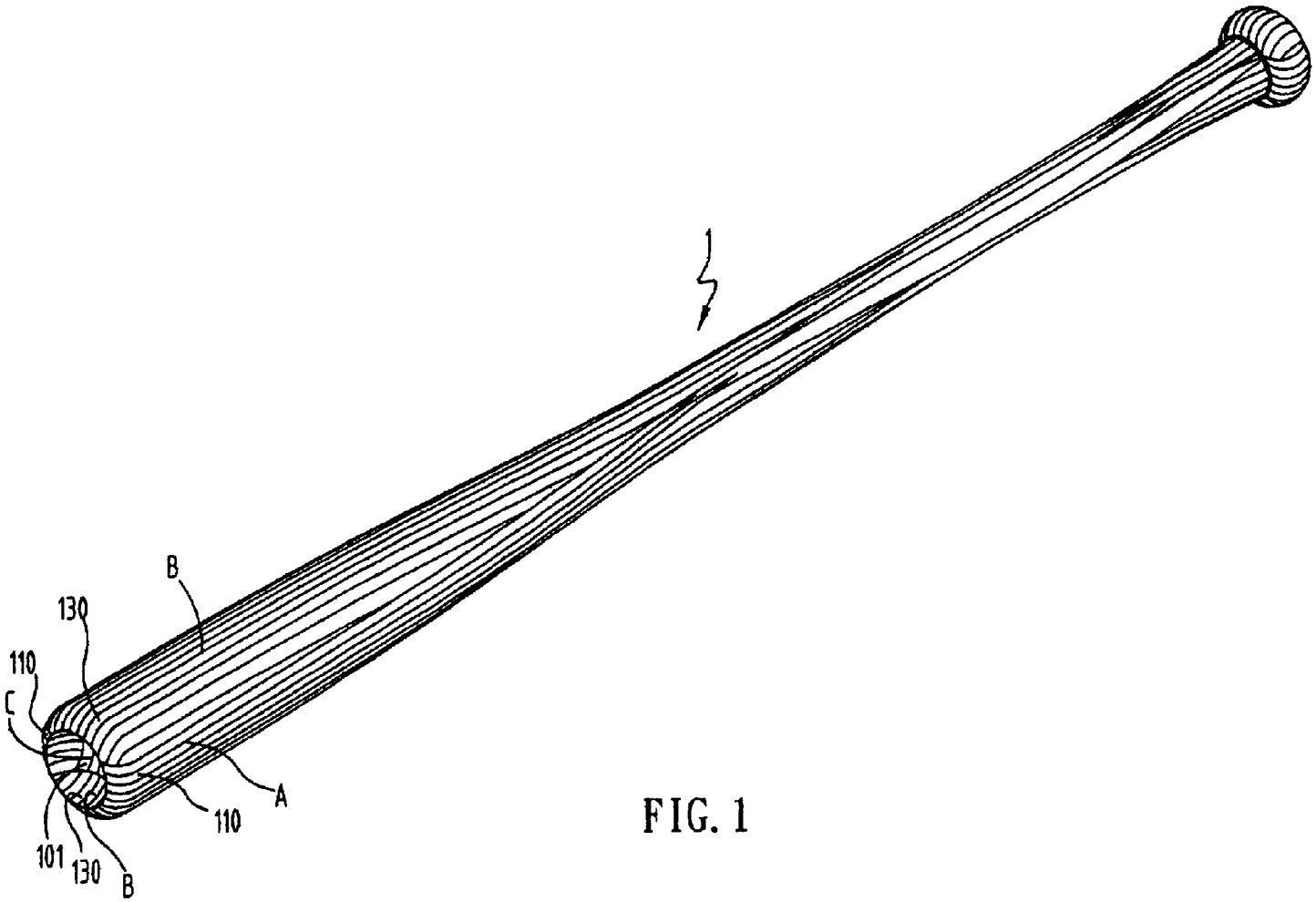
FIG. 1 is a perspective view of a bat structure in accordance with the preferred embodiment of the present invention.

Referring to the drawings and initially to FIGS. 1–5, a bat structure 1 in accordance with the preferred embodiment of the present invention comprises a central portion 10, two symmetrical opposite side enclosure portions 11, and two symmetrical opposite outer enclosure portions 13. Preferably, the central portion 10, each of the two side enclosure portions 11 and each of the two outer enclosure portions 13 are made of the plant, such as wood, bamboo or the like. Each of the two side enclosure portions 11 has a hardness greater than that of the central portion 10. Each of the two outer enclosure portions 13 has a hardness greater than that of the central portion 10.

The central portion 10 has a substantially square cross-section. The central portion 10 has four sides, and the two opposite side enclosure portions 11 and the two opposite outer enclosure portions 13 are wound around the four sides of the central portion 10 in a staggered manner.

Figure 3:
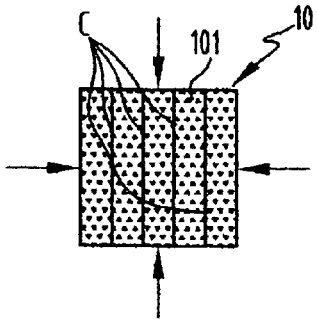
FIG. 3 is a side plan cross-sectional view of the central portion of the bat store in accordance with the preferred embodiment of the present invention.

As shown in FIG. 3, the central portion 10 includes a plurality of plates 101 made of the plant, such as wood, bamboo or the like. Preferably, the plates 101 of the central portion 10 are laminated, pressed and bonded together to form the central portion 10.

Figure 4:
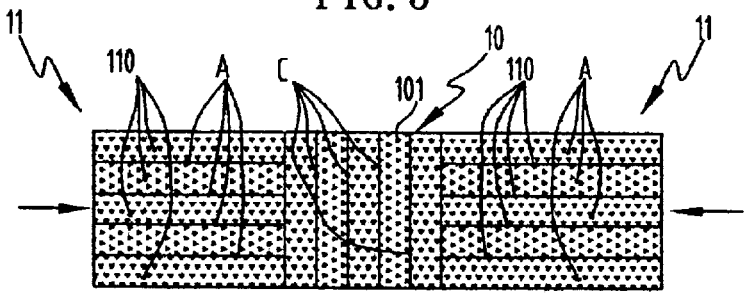
FIG. 4 is a side plan cross-sectional assembly view of the central portion and the two side enclosure portions of the bat structure in accordance with the preferred embodiment of the present invention.

As shown in FIG. 4, each of the two side enclosure portions 11 includes a plurality of plates 110 made of the plant, such as wood, bamboo or the like. Preferably, the plates 110 of each of the two side enclosure portions 11 are laminated, pressed and bonded together to form each of the two side enclosure portions 11. In addition, the bonding faces A between the plates 110 of each of the two side enclosure portions 11 are vertical to the bonding faces C between the plates 101 of the central portion 10.

Figure 5:
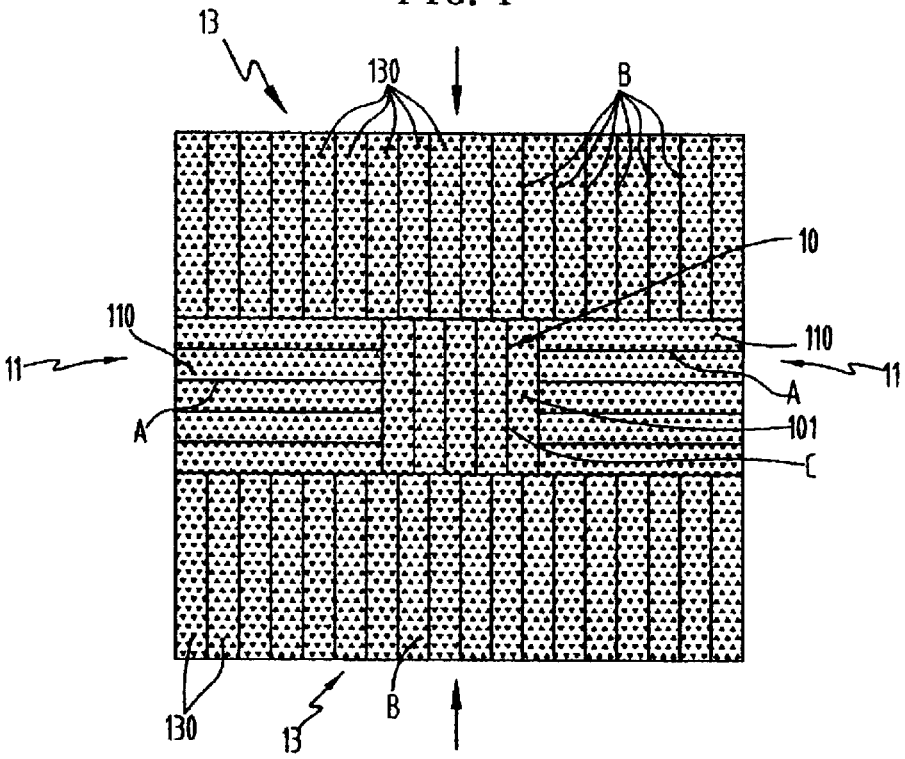
FIG. 5 is a side plan cross-sectional assembly view of the central potion, the two side enclosure portions and the two outer enclosure portions of the bat structure in accordance with the preferred embodiment of the present invention.

As shown in FIG. 5, each of the outer enclosure portions 13 includes a plurality of plates 130 made of the plant, such as wood, bamboo or the like. Preferably, the plates 130 of each of the two outer enclosure portions 13 are laminated, pressed and bonded together to form each of the two outer enclosure portions 13. In addition, the bonding faces B between the plates 130 of each of the two outer enclosure portions 13 are in parallel with the bonding faces C between the plates 101 of the central portion 10 and are vertical to the bonding faces A between the plates 110 of each of the two side enclosure portions 11.

In fabrication, the plates 101 of the central portion 10 are laminated, pressed and bonded together to form the central portion 10 as shown in FIG. 3. Then, the plates 110 of each of the two side enclosure portions 11 are laminated, pressed and bonded together to form each of the two side enclosure portions 11 as shown in FIG. 4. Then, the two opposite side enclosure portions 11 are bonded on two opposite sides of the canal portion 10, with the bonding faces A between the plates 110 of each of the two side enclosure portions 11 being vertical to the bonding faces C between the plates 101 of the central portion 10. Then, the plate 130 of each of the two outer enclosure portions 13 are laminated, pressed and bonded together to form each of the two outer enclosure portions 13 as shown in FIG. 5. Then, the two opposite outer enclosure portions 13 are bonded on the other two opposite sides of the central portion 10 with the bonding faces B between the plates 130 of each of the two outer enclosure portions 13 being in parallel with the bonding faces C between the plates 101 of the central portion 10 and vertical to the bonding faces A between the plates 110 of each of the two side enclosure portions 11.

Figure 2:
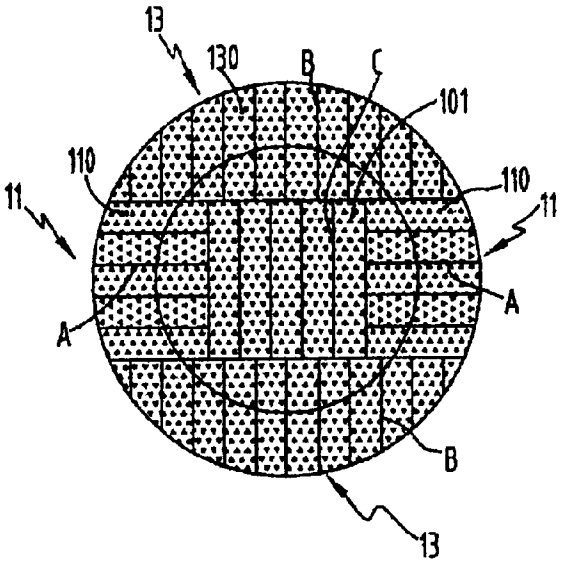
FIG. 2 is a side plan cross-sectional view of the bat structure as shown in FIG. 1.

Thus, a combination of the central portion 10, the two side enclosure portions 11 and the two outer enclosure portions 13 is formed as shown in FIG. 5. Then, the combination of the central portion 10, the two side enclosure portions 11 and the two outer enclose portions 13 is worked by a turning process, thereby forming a bat structure 1 as shown in FIGS. 1 and 2.

In practice, when either one of the two side enclosure portions 11 or either one of the two outer enclosure portions 13 is hit by the ball, the striking force applied by the ball is transmitted from the plates 110 of either one of the two side enclosure portions 11 or the plates 130 of either one of the two outer enclosure portions 13 to the plates 101 of the central portion 10. At this time, each of the two side enclosure portions 11 has a hardness greater than that of the central portion 10 and each of the two outer enclosure portions 13 has a hardness greater than that of the central portion 10.

Thus, the striking force from the plates 110 of either one of the two side enclosure portions 11 or the plates 130 of either one of the two outer enclosure portions 13 is absorbed by the plates 101 of the central portion 10, thereby achieving a shock-absorbing and buffering effect, so that the batter can feel more confortable when the bat structure 1 hits the ball. In addition, the bat structure 1 can provide a shock-absorbing and buffering effect to prevent the bat structure 1 from being broken due to a larger shock, thereby increasing the lifetime of the bat structure 1.

Figure 6:
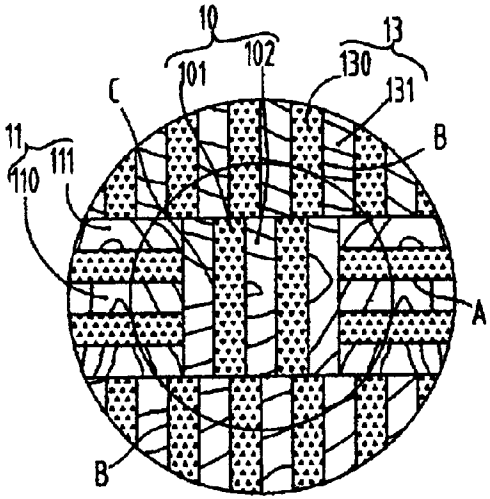
FIG. 6 is a side plan cross-sectional assembly view of a bat structure in accordance with another embodiment of the present invention.

Referring to FIG. 6, a bat structure in accordance with another embodiment of the present invention is shown, wherein the central portion 10 includes a plurality of bamboo plates 101 and a plurality of wood plates 102. The bamboo plates 101 and the wood plates 102 are laminated, pressed and bonded together in a staggered manner to form the central portion 10.

In addition, each of the two side enclosure portions 11 includes a plurality of bamboo plates 110 and a plurality of wood plates 111. The bamboo plates 110 and the wood plates 111 are laminated, pressed and bonded together in a staggered manner to form each of the two side enclosure portions 11. In addition, the bonding faces A between the bamboo plates 110 and the wood plates 111 of each of the two side enclosure portions 11 are vertical to the bonding faces C between the bamboo plates 101 and the wood plates 102 of the central portion 10.

In addition, each of the two outer enclosure portions 13 includes a plurality of bamboo plates 130 and a plurality of wood plates 131. The bamboo plates 130 and the wood plates 131 are laminated pressed and bonded together in a staggered manner to form each of the two outer enclosure portions 13. In addition, the bonding faces B between the bamboo plates 130 and the wood plates 131 of each of the two outer enclosure portions 13 are in parallel with the bonding faces C between the bamboo plates 101 and the wood plates 102 of the central portion 10 and are vertical to the bonding faces A between the bamboo plates 110 and the wood plates 111 of each of the two side enclosure portions 11.

Figure 7:
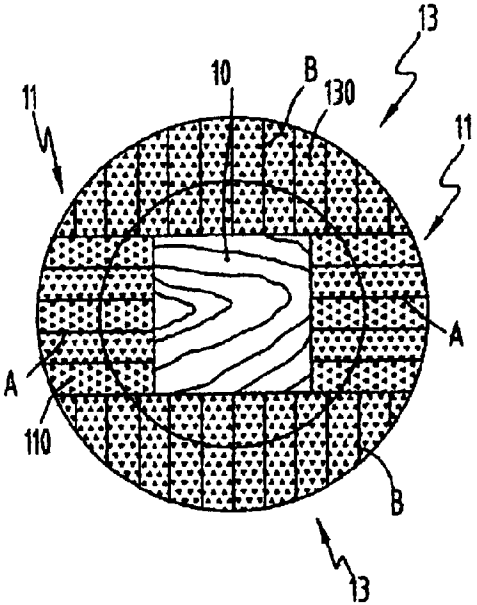
FIG. 7 is a side plan cross-sectional assembly view of a bat structure in accordance with another embodiment of the present invention.

Referring to FIG. 7, a bat structure in accordance with another embodiment of the present invention is shown, wherein the central portion 10 is made of a single wood.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A bat structure, comprising a central portion, two symmetrical opposite side enclosure portions, and two symmetrical opposite outer enclosure portions, wherein:

the central portion has a substantially square cross-section and has four sides;

the central portion includes a plurality of plates;

the two opposite side enclosure portions and the two opposite outer enclosure portions are wound around the four sides of the central portion in a staggered manner;

each of the two side enclosure portions includes a plurality of plates;

the bonding faces between the plates of each of the two side enclosure portions are vertical to the bonding faces between the plates of the central portion;

each of the two side enclosure portions has a hardness greater than that of the central portion;

each of the two outer enclosure portions includes a plurality of plates;

the plates of each of the two outer enclosure portions are laminated, pressed and bonded together to form each of the two outer enclosure portions;

each of the two outer enclosure portions has a hardness greater than that of the central portion.

2. The bat structure in accordance with claim 1, wherein the central portion is made of wood or bamboo.

3. The bat structure in accordance with claim 1, wherein each of the two side enclosure portions are made of wood or bamboo.

4. The bat structure in accordance with claim 1, wherein each of the two outer enclosure portions are made of wood or bamboo.

5. The bat structure in accordance with claim 1, wherein the plates of the central portion are laminated, pressed and bonded together to form the central portion.

6. The bat structure in accordance with claim 1, wherein the plates of each of the two side enclosure portions are laminated, pressed and bonded together to form each of the two side enclosure portions.

7. The bat structure in accordance with claim 1, wherein the bonding faces between the plates of each of the two outer enclosure portions are in parallel with the bonding faces between the plates of the central portion and are vertical to the bonding faces between the plates of each of the two side enclosure portions.

8. The bat structure in accordance with claim 1, wherein the central portion includes a plurality of bamboo plates and a plurality of wood plates, each of the two side enclosure portions includes a plurality of bamboo plates and a plurality of wood plates, and each of the two outer enclosure portions includes a plurality of bamboo plates and a plurality of wood plates.

9. The bat structure in accordance with claim 8, wherein the bamboo plates and the wood plates are laminated, pressed and bonded together in a staggered manner to form the central portion.

10. The bat structure in accordance with claim 8, wherein the bamboo plates and the wood plates are laminated, pressed and bonded together in a staggered manner to form each of the two side enclosure portions.

11. The bat structure in accordance with claim 8, wherein the bamboo plates and the wood plates are laminated, pressed and bonded together in a staggered manner to form each of the two outer enclosure portions.

* * * * *